US006796060B1

(12) United States Patent
Meester et al.

(10) Patent No.: US 6,796,060 B1
(45) Date of Patent: Sep. 28, 2004

(54) VEHICLE LICENSE PLATE HOLDER ASSEMBLY WITH ROADSIDE ASSISTANCE REQUEST MECHANISM

(76) Inventors: David Meester, 306 A Roberts Ave., York, SC (US) 29745; Rick Sain, 306 A Roberts Ave., York, SC (US) 29745

( * ) Notice: Subject to any disclaimer, the term of this patent is extended or adjusted under 35 U.S.C. 154(b) by 0 days.

(21) Appl. No.: 10/696,303

(22) Filed: Oct. 28, 2003

(51) Int. Cl.[7] ..... G09F 7/00

(52) U.S. Cl. ..... 40/210; 40/209; 40/204; 40/591

(58) Field of Search ..... 40/200, 204, 209, 40/210, 211, 541, 591

(56) References Cited

U.S. PATENT DOCUMENTS 2,135,191 A * 11/1938 McBrady ..... 40/210
2,575,211 A * 11/1951 Flacke ..... 40/204
2,635,227 A * 4/1953 Frank ..... 40/211
2,803,810 A * 8/1957 Evans ..... 40/211
3,439,440 A * 4/1969 Klekamp ..... 40/209
3,908,296 A * 9/1975 Harrison ..... 40/210
5,533,287 A * 7/1996 Cole ..... 40/591
5,603,178 A * 2/1997 Morrison ..... 40/591
5,652,565 A * 7/1997 Salcedas et al. ..... 40/591
5,870,841 A * 2/1999 Brody et al. ..... 40/200
5,878,516 A * 3/1999 Amirian ..... 40/591
6,381,886 B1 * 5/2002 Chou ..... 40/209

* cited by examiner

*Primary Examiner*—Gary C. Hoge
(74) *Attorney, Agent, or Firm*—Summa & Allan, P.A.

(57) ABSTRACT

A vehicle license plate holder assembly with roadside assistance request mechanism that includes a vehicle mountable housing assembly having a back lighted "HELP" sign and a pivoting license plate bracket having two pivoting arms each pivotally connected at a housing connection end to the vehicle mountable housing assembly. The license plate support plate is moveable between a "HELP" sign covering position and a "HELP" sign revealing position. The back lighted "HELP" sign includes a light source operable in either a continuous or a blinking mode.

1 Claim, 2 Drawing Sheets

VEHICLE LICENSE PLATE HOLDER ASSEMBLY WITH ROADSIDE ASSISTANCE REQUEST MECHANISM

TECHNICAL FIELD

The present invention relates to emergency equipment for vehicles and more particularly to a vehicle license plate holder assembly with roadside assistance request mechanism that includes a vehicle mountable housing assembly having a back lighted "HELP" sign and a pivoting license plate bracket having two pivoting arms each pivotally connected at a housing connection end to the vehicle mountable housing assembly and pivotally connected at a support plate connecting end to a side of a license plate support plate adapted such that the license plate support plate is movable between a "HELP" sign covering position and a "HELP" sign revealing position; the license plate support plate having license plate attachment apertures for allowing attachment thereto of a vehicle license plate; the back lighted "HELP" sign including a light source that is operable in either a continuous or a blinking mode.

BACKGROUND ART

It is often necessary for a vehicle operator to signal to passing vehicles that the vehicle operator is in need of help. It would be desirable, therefore to have a "HELP" requesting sign or the like that may be displayed so that passing motorists have an opportunity to view the request and either directly render assistance or to call an assistance providing organization, such as the police, to request they send assistance to the vehicle location. Because help may be needed when it is dark, it would be a further benefit to have a "HELP" requesting sign that was illuminated in either a continuous or a blinking manner to make it visible in the dark. Because it would be desirable to hide the "HELP" sign when it is not needed, it would further be desirable to have such a "HELP" sign that was hidden behind the vehicle license plate when not in use but which could easily and rapidly be displayed when needed.

GENERAL SUMMARY DISCUSSION OF INVENTION

It is thus an object of the invention to provide vehicle license plate holder assembly with roadside assistance request mechanism that includes a vehicle mountable housing assembly having a back lighted "HELP" sign and a pivoting license plate bracket having two pivoting arms each pivotally connected at a housing connection end to the vehicle mountable housing assembly and pivotally connected at a support plate connecting end to a side of a license plate support plate adapted such that the license plate support plate is movable between a "HELP" sign covering position and a "HELP" sign revealing position; the license plate support plate having license plate attachment apertures for allowing attachment thereto of a vehicle license plate; the back lighted "HELP" sign including a light source that is operable in either a continuous or a blinking mode.

Accordingly, a vehicle license plate holder assembly with roadside assistance request mechanism is provided. The vehicle license plate holder assembly with roadside assistance request mechanism includes a vehicle mountable housing assembly having a back lighted "HELP" sign and a pivoting license plate bracket having two pivoting arms each pivotally connected at a housing connection end to the vehicle mountable housing assembly and pivotally connected at a support plate connecting end to a side of a license plate support plate adapted such that the license plate support plate is movable between a "HELP" sign covering position and a "HELP" sign revealing position; the license plate support plate having license plate attachment apertures for allowing attachment thereto of a vehicle license plate; the back lighted "HELP" sign including a light source that is operable in either a continuous or a blinking mode.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
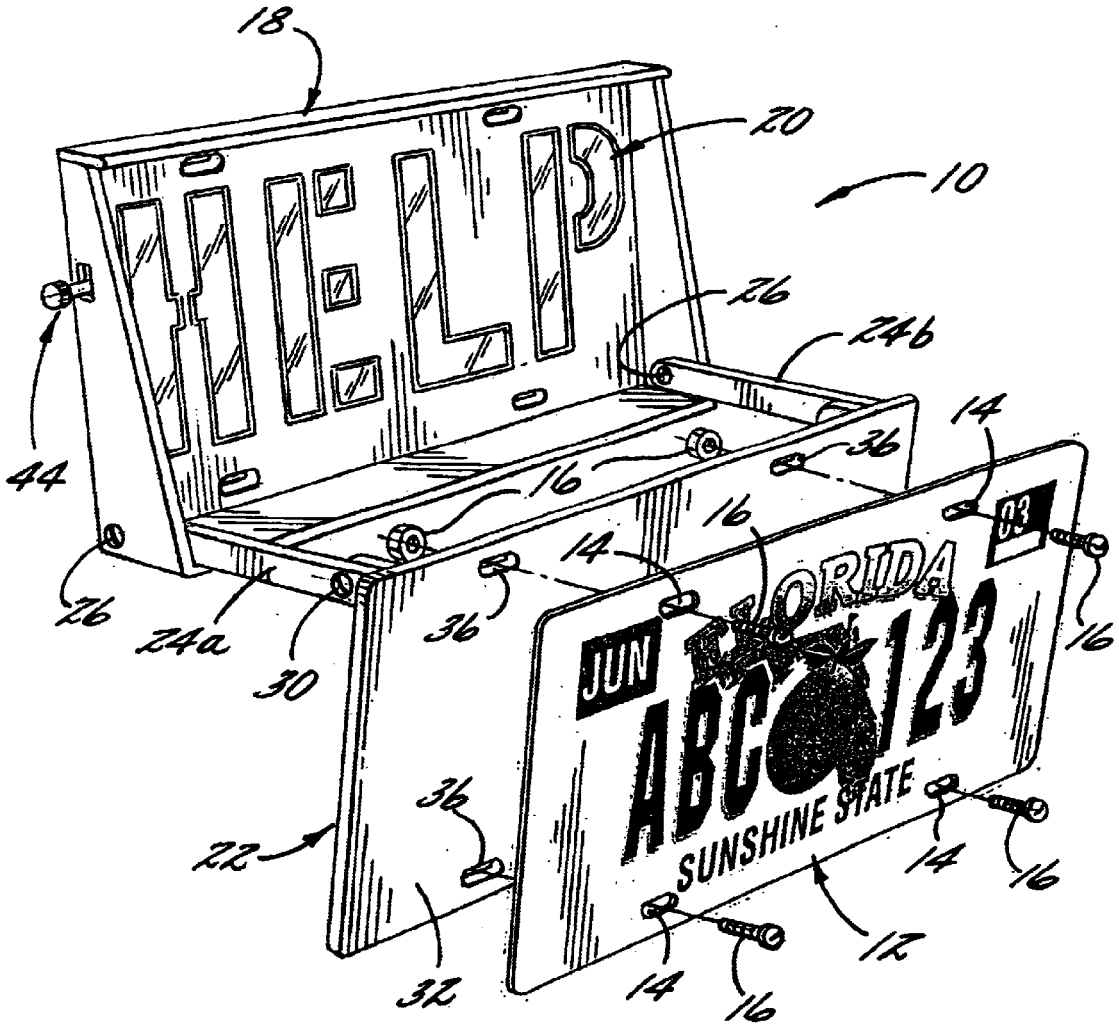
FIG. 1 is a perspective view of an exemplary embodiment of the vehicle license plate holder assembly with roadside assistance request mechanism of the present invention along with a representative vehicle licence plate.
Figure 2:
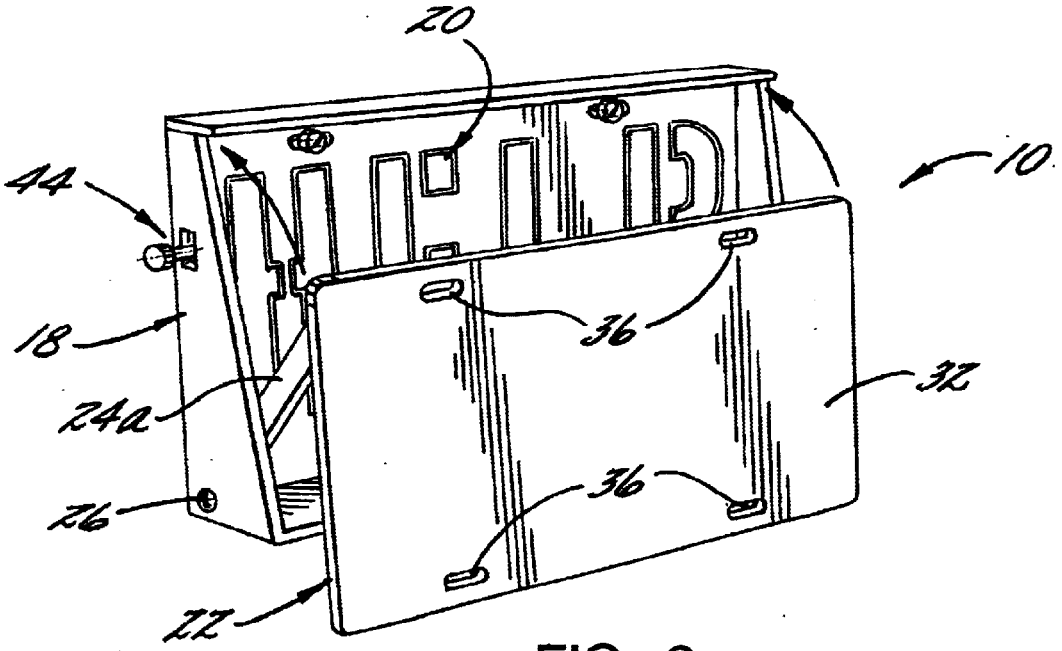
FIG. 2 is a perspective view of the vehicle license plate holder assembly with roadside assistance request mechanism of FIG. 1 with the license plate support plate thereof moved between the "HELP" sign covering position and the "HELP" sign revealing position.
Figure 3:
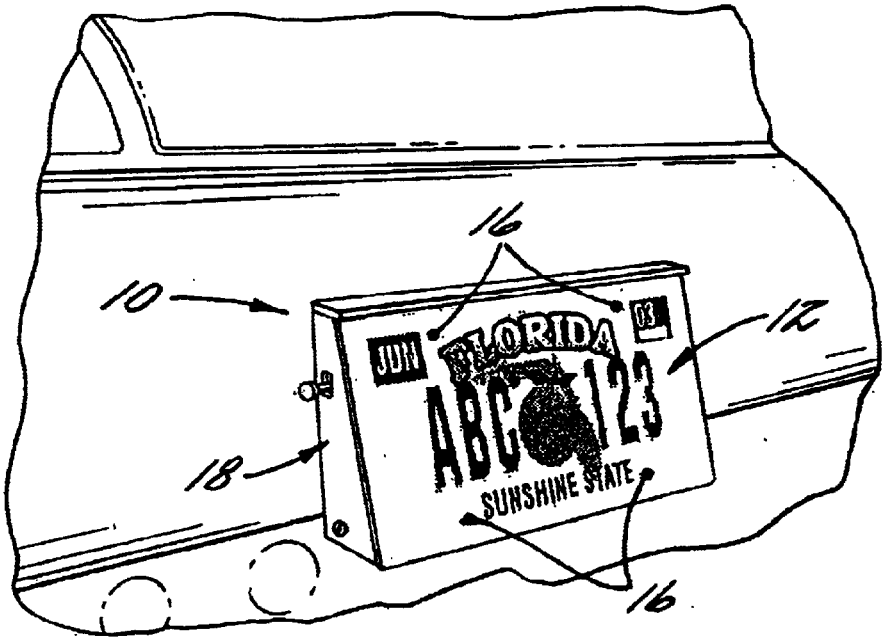
FIG. 3 is a perspective view of the vehicle license plate holder assembly with roadside assistance request mechanism of FIG. 1 secured to the rear of a truck, the representative vehicle license plate secured to the license late support plate, and the license plate support plate positioned in the "HELP" sign covering position.

FIGS. 1–3 show various aspects of an exemplary embodiment of the vehicle license plate holder assembly with roadside assistance request mechanism of the present invention, generally designated 10, and a representative vehicle license plate, generally designated 12, having four attachment bolt passage apertures 14 provided therethrough and four securing bolt/nut assemblies 16

Vehicle license plate holder assembly with roadside assistance request mechanism 10 includes a vehicle mountable housing assembly, generally designated 18, having a back lighted "HELP" sign, generally designated 20, and a pivoting license plate bracket, generally designated 22, having two pivoting arms 24*a*, 24*b*. Each pivoting arm 24*a*, 24*b* is pivotally connected at a housing connection end 26 to vehicle mountable housing assembly 18 and pivotally connected at a support plate connecting end 30 to a side of a license plate support plate, generally designated 32, that is adapted such that the license plate support plate 32 is movable between a "HELP" sign covering position (shown in FIG. 3) and a "HELP" sign revealing position (shown in FIG. 1).

License plate support plate 32 has four, elongated license plate attachment apertures 36 for allowing attachment thereto of vehicle license plate using the securing bolt/nut assemblies 16. Back lighted "HELP" sign 20 includes a light source 44 having a three-position switch to allow the light source to be placed in the off mode, the continuous illumination mode, or a blinking illumination mode.

It can be seen from the preceding description that a vehicle license plate holder assembly with roadside assistance request mechanism has been provided.

It is noted that the embodiment of the vehicle license plate holder assembly with roadside assistance request mechanism described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A vehicle license plate holder assembly with roadside assistance request mechanism comprising:

a vehicle mountable housing assembly having a back lighted "HELP" sign and a pivoting license plate bracket having two pivoting arms each pivotally connected at a housing connection end to the vehicle mountable housing assembly and pivotally connected at a support plate connecting end to a side of a license plate support plate adapted such that the license plate support plate is movable between a "HELP" sign covering position and a "HELP" sign revealing position;

the license plate support plate having license plate attachment apertures for allowing attachment thereto of a vehicle license plate;

the back lighted "HELP" sign including a light source that is operable in either a continuous or a blinking mode.

* * * * *